US007527533B2

(12) United States Patent
Lappoehn

(10) Patent No.: US 7,527,533 B2
(45) Date of Patent: May 5, 2009

(54) PRESS-FIT CONTACT

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/687,268

(22) Filed: Mar. 16, 2007

(65) Prior Publication Data

US 2007/0218778 A1 Sep. 20, 2007

(30) Foreign Application Priority Data

Mar. 17, 2006 (DE) ..... 10 2006 012 722

(51) Int. Cl.
*H01R 13/42* (2006.01)

(52) U.S. Cl. ..... 439/751; 439/943; 439/823; 439/873

(58) Field of Classification Search ..... 439/751, 439/84, 82, 733.1, 823, 873, 943
See application file for complete search history.

(56) References Cited

U.S. PATENT DOCUMENTS 5,752,839 A * 5/1998 Fiacco et al. ..... 439/63

FOREIGN PATENT DOCUMENTS

| | | |
|---|---|---|
| DE | 3221844 | 12/1984 |
| DE | 6960598 | 11/2001 |
| DE | 10119695 | 11/2002 |
| DE | 102005018780 | 11/2005 |
| DE | 102004028202 | 12/2005 |
| JP | 2003346950 | 12/2003 |

* cited by examiner

*Primary Examiner*—Briggitte R Hammond
*Assistant Examiner*—Vanessa Girardi
(74) *Attorney, Agent, or Firm*—Collard & Roe, P.C.

(57) ABSTRACT

A press-fit contact for a plug-in connector, a conductor bar or the like, has a press-in pin at its rear end. A slot is provided in lengthwise direction of the press-in pin. At least one projection is disposed on at least one boundary face of the slot, and a recess, neighboring the projection, is disposed in the circumferential direction of the press-in pin. The recess forms together with the projection a spring element that provides at least part of the retention pressure in the pressed-in condition of the press-in pin.

10 Claims, 4 Drawing Sheets

PRESS-FIT CONTACT

PRIOR ART

The present invention relates to a press-fit contact for a plug-in connector, a conductor bar or the like, according to the preamble of the independent Claim.

Plug-in connection for printed-wiring boards are offered by Applicant in a variety of different designs. A plug-in connection for printed-wiring boards comprises two plug-in connector elements that can be brought into engagement one with the other. A plug-in connector element generally comprises a plurality of electrically conductive contacts arranged in a plastic housing. A first plug-in connector element is arranged on the printed-wiring board. For connecting the printed-wiring board with other wiring components the second plug-in connector element is fitted on the first plug-in connector element. A plug-in connection of that kind, which comprises a plurality of plug-in contacts arranged in two rows that are implemented as pin contacts and slot contacts, has been known for example from DE 101 19 695 A1. The plug-in connector element arranged on the printed-wiring board is implemented as SMD component where the plug-in connectors are soldered to the surface of the printed-wiring board.

According to a different solution, the plug-in contacts are guided through bores in the card and are soldered to the bottom of the card. As an alternative to the soldering solution the rear end of the plug-in contact may be implemented as press-in pin that is pressed into a bore in the card or a conductor bar by application of pressure. Such a press-fit contact is suited especially for establishing high-current connections.

DE 10 2004 028 202 A1 describes a press-fit contact with a press-in pin provided in its rear portion, which pin is subdivided into two legs, related to the lengthwise direction of the press-fit contact, that are expanded so as to form a slot between the two legs. By expanding the legs in this way, a spring element is produced that provides the necessary retention pressure in the fitted condition of the element.

Now, it is the object of the present invention to provide a press-fit contact for a plug-in connector, a conductor bar or the like, that provides high retention pressure.

DISCLOSURE OF THE INVENTION

In the press-fit contact according to the invention for a plug-in connector, a conductor bar or the like, having a press-in pin at its rear end, there are provided, in lengthwise direction of the press-in pin, a slot, at least one projection disposed on the boundary face of the slot, and a recess neighboring the projection disposed in the circumferential direction of the press-in pin.

The projection, in combination with the recess, provides an elastic element or spring element, which in the pressed-in condition of the contact pin provides an additional high contact pressure or retention pressure.

The resilient effect results from the fact that in the pressed-in condition of the contact pin the projection can resiliently engage into the neighboring recess. The press-fit contact according to the invention therefore permits a strong connection of the press-in pin with the corresponding recess or bore both in mechanical and in electrical respects.

Advantageous further developments and embodiments of the press-fit contact according to the invention are apparent from the attached claims.

One advantageous embodiment provides that at least one projection is provided on both boundary faces of the slot, with a recess provided adjacent the projection, and that the projections face each other at the slot. In the case of that embodiment, the two oppositely arranged projections are pressed one toward the other so that the projections, in combination with the associated recesses, form elastic elements. Thus, an additional increase of the retention pressure in a bore or, generally, in a receiving opening for the press-in pin can be achieved.

According to one embodiment, the recess is configured as an elongated hole in the lengthwise direction of the press-in pin. A suitable projection, which preferably extends in lengthwise direction up to a length maximally equal to the length of the elongated hole, in combination with the recess, makes it possible to selectively influence the properties of the elastic element so obtained and to influence the retention pressure in the pressed-in condition of the press-fit contact.

According to one further development, at least one wedge is arranged on the outer surface of the press-in pin in lengthwise direction. The wedge provides a defined press-in area in the bore for the press-in pin and leads to a desirable non-uniform surface pressure.

An especially advantageous further development of the press-fit contact according to the invention provides that a supporting edge is disposed preferably in the forward area of the press-fit contact. The supporting edge provides a supporting surface that can be used especially for pressing in the press-fit contact according to the invention.

According to another further development, an expanded section of the cross-section is provided in the area of the contact body, which on the one hand improves the stability of the press-fit contact and, on the other hand, reduces the ohmic resistance. It is of particular advantage if the supporting edge is formed simultaneously with the expansion of the cross-section.

According to another further development, at least one key is arranged in the area of the contact body. During assembly of the press-fit contact 10 in a plug housing, the key engages a corresponding guide provided in the plug housing, thereby fixing the press-fit contact according to the invention at least against undesirable rotation.

According to an especially advantageous embodiment, the press-fit contact according to the invention is produced from a punching.

The punching may be worked in plane condition, for example by milling. Especially, the at least one projection, the at least one recess, the at least one wedge, the expansion of the cross-section, maybe in combination with the supporting edge, and the at least one key can be formed in a simple way in the punching by milling.

The at least one projection may be formed by removing material from the punching on the at least one side of the slot, which later is to become a boundary face, in an area adjacent to the projection to be formed later, in lengthwise direction.

Especially, a plurality of press-fit contacts may be formed from a large punching in a single operation. After completion of the punching, the press-fit contact is given a circular shape by rolling.

Other advantageous further developments and embodiments of the press-fit contact according to the invention will become apparent from the specification. Certain embodiments of the press-fit contact according to the invention are illustrated in the drawing and will be described hereafter in more detail.

Figure 1:
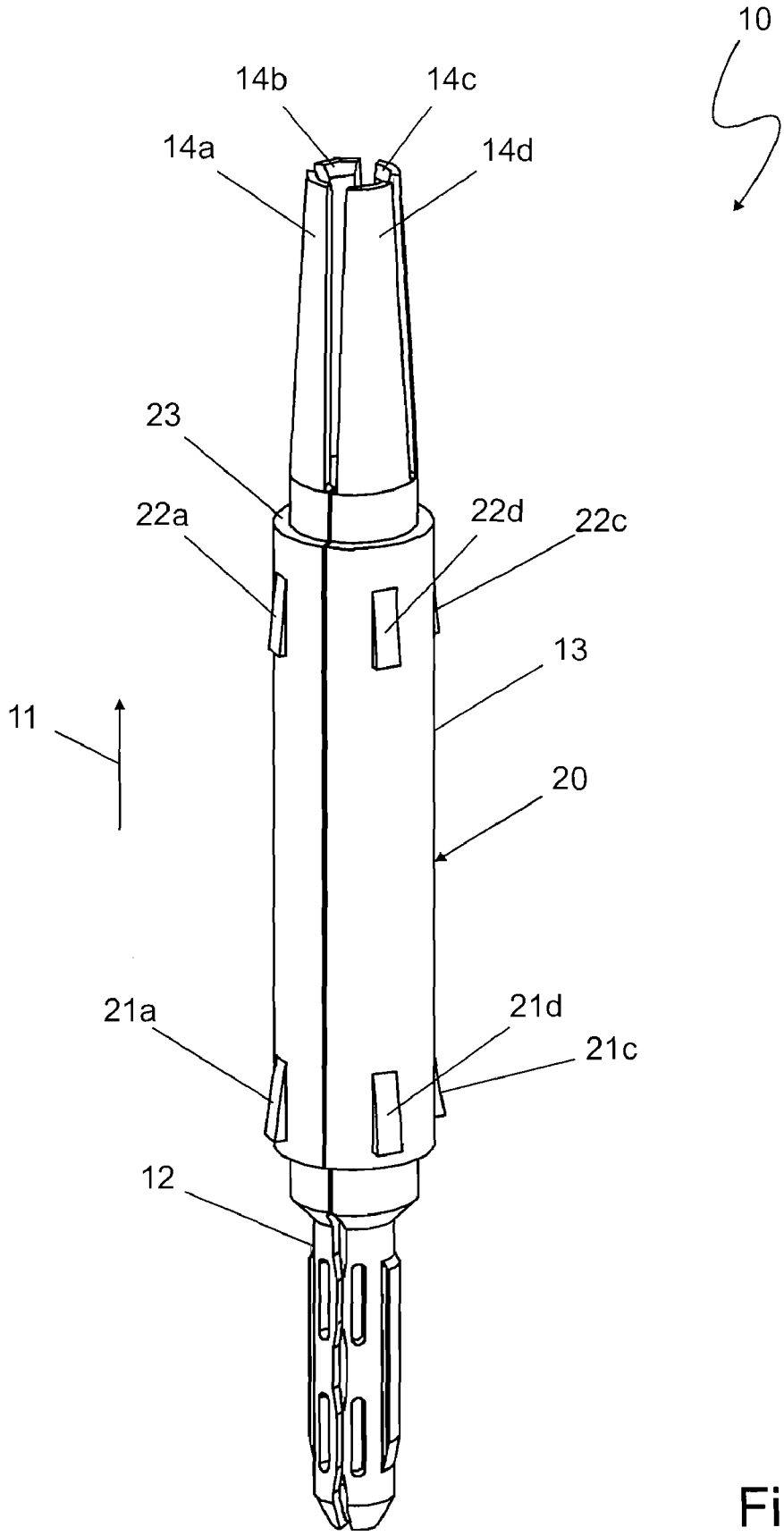
FIG. 1 shows a perspective overall view of a press-fit contact according to the invention.

FIG. 1 shows a perspective overall view of the press-fit contact 10 according to the invention. The press-fit contact 10 comprises, related to its lengthwise direction 11, a press-in pin 12 on its rearward end, a contact body 13 in its central area and contact springs 14*a*-14*d* on its forward end.

At least one key is arranged on the outer surface 20 of the contact body 13. In the illustrated embodiment, four keys 21*a*-21*d* are arranged on the outer surface 20, at the rear end of the contact body 13, of which three keys 21*a*, 21*c*, 21*d* are visible in the drawing. Further, four additional keys 22*a*-22*d* are provided on the outer surface 20, at the forward end of the contact body 13, of which three keys 22*a*, 22*c*, 22*d* are visible in the drawing. The at least one key 21*a*-21*d*; 22*a*-22*d* serves for fixing the press-fit contact 10 at least against rotation in a plug housing that will be described hereafter.

The press-fit contact 10 comprises a supporting edge 23 which in the illustrated embodiment is formed from the forward end of the contact body 13. The supporting edge 23 provides an operative surface for an abutment for the supporting edge, to be described further below, by which the press-fit contact 10 is pressed into the receiving opening, for example a bore in a printed-wiring board not shown, a conductor bar or the like.

Figure 2:
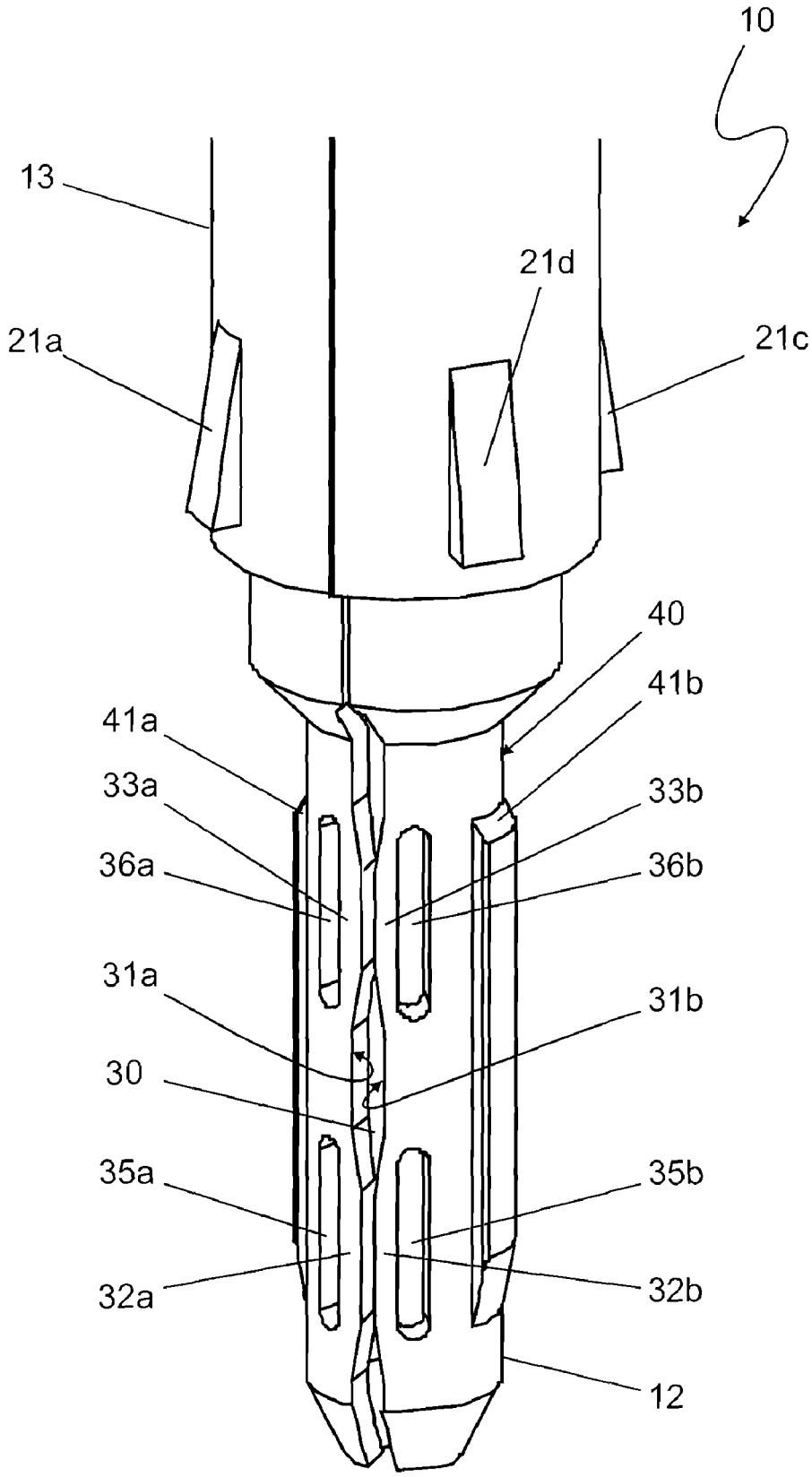
FIG. 2 shows a perspective view of a press-in pin of the press-fit contact illustrated in FIG. 1.

FIG. 2 shows a perspective view of a press-in pin 12 of the press-fit contact 10. The press-in pin 12 comprises a slot 30, extending in the lengthwise direction 11. At the slot 30, first and second boundary faces 31*a*, 31*b* are disposed one opposite the other.

Provided on at least one boundary face 31*a*, 31*b* is at least one projection 32*a*, 33*a*, with a recess 35*a*, 36*a* provided adjacent to such projection in the circumferential direction 34 of the press-in pin 12. The at least one projection 32*a*, 33*a* forms together with the adjacent projection 35*a*, 36*a* an elastic element or a spring element whereby the projection 32*a*, 33*a* can resiliently engage the neighboring recess 35*a*, 36*a* in the pressed-in condition of the press-in pin 12, so that the press-in pin 12 is capable of providing a high retention pressure in its pressed-in condition. The recess 35*a*, 36*a* may also be described as a cut-out.

In the illustrated embodiment, the recess 35*a*, 36*a* is configured as an oblong hole extending in the lengthwise direction 11 of the press-fit contact 10. The oblong hole has the shape of a needle eye which can be engaged resiliently by the projection 32*a*, 33*a*.

In the illustrated embodiment, two projections 32*a*, 33*a* with adjacent recesses 35*a*, 36*a* are provided in the lengthwise direction 11 of the press-in pin 12. The number of projections 32*a*, 33*a* may vary depending on the length of the press-in pin 12. It is thus possible to influence the retention pressure in the pressed-in condition of the press-in pin 12.

Another way of influencing the retention pressure consists in varying the length of the projection 32*a*, 33*a* in lengthwise direction 11 of the contact pin 12, in which case the length of the respective adjacent recess 35*a*, 36*a* has to be adapted to the length of the projection 32*a*, 33*a*. Preferably, the length of the projection 32*a*, 33*a* is selected to be smaller than or maximally equal to the length of the recess 35*a*, 36*a* in order to permit the projection 32*a*, 33*a* to resiliently engage the recess 35*a*, 36*a* without any problem.

In the illustrated embodiment, at least one projection 32*a*, 33*a*, is provided not only on the first boundary face 31*a*. In the illustrated embodiment, at least one projection 32*a*, 32*b*; 33*a*, 33*b* is provided on both boundary faces 31*a*, 31*b*, each adjoining a neighboring recess 35*a*, 35*b*, 36*a*, 36*b*. The projections 32*a*, 32*b*; 33*a*, 33*b* face each other at the slot 30, in the circumferential direction. By disposing projections 32*a*, 32*b*, 33*a*, 33*b* on both sides, at least two elastic elements are provided where projections 32*a*, 32*b*; 33*a*, 33*b* can resiliently engage neighboring recesses 35*a*, 35*b*; 36*a*, 36*b*. This likewise permits the retention pressure of the press-in pin 12 to be influenced in its pressed-in condition.

According to one embodiment, at least one key is arranged on the outer surface 40 of the press-in pin 12 in the lengthwise direction 11. In the illustrated embodiment, two keys 41*a*, 41*b* are provided. The at least one key 41*a*, 41*b* leads to a non-uniform surface pressure in the pressed-in condition of the press-in pin 12, which in this case is produced intentionally in order to increase the local pressure.

Figure 3:
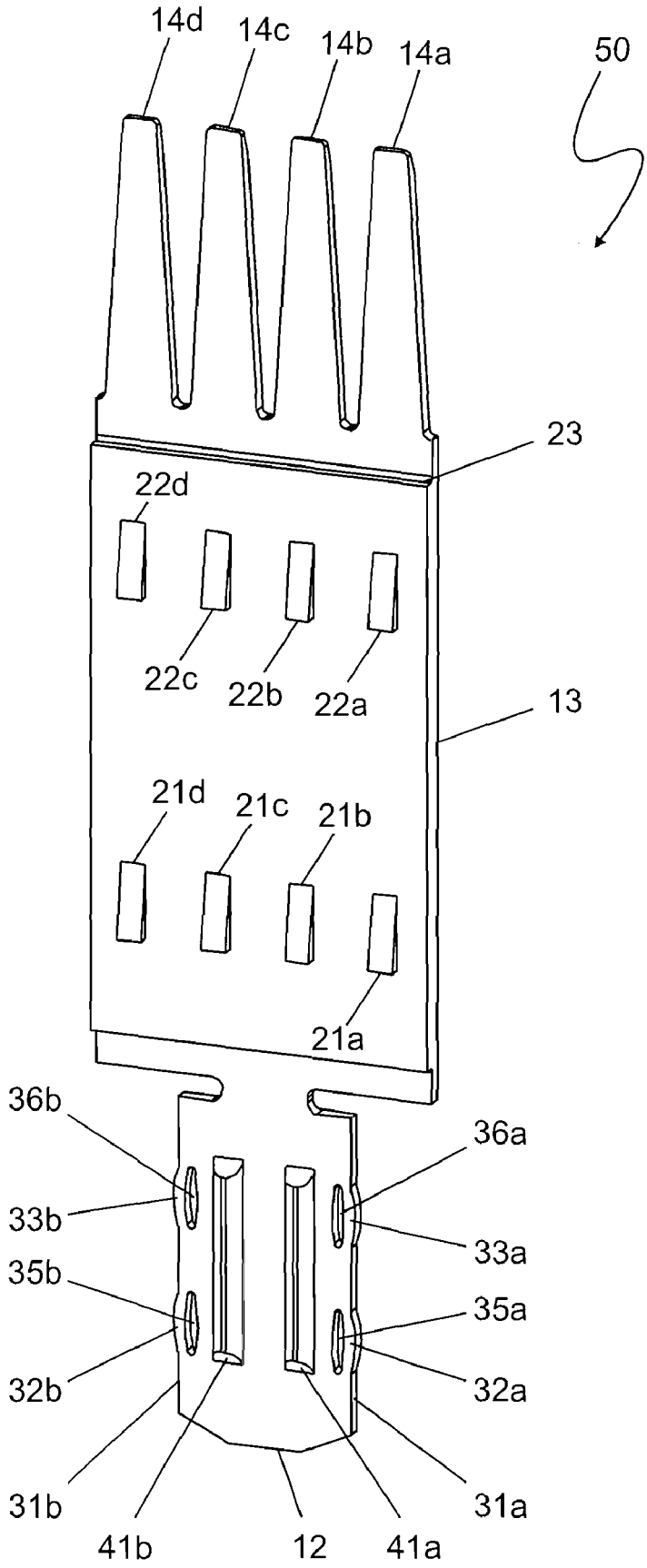
FIG. 3 shows a punching from which the press-fit contact illustrated in FIG. 1 is made.

In principle, the press-fit contact 10 according to the invention may also be formed by turning. According to an especially advantageous embodiment it is, however, provided to produce the press-fit contact 10 according to the invention from a punching 50, which is illustrated in FIG. 3. The punching 50 may be worked in plane condition, for example by milling. An essential advantage is derived from the fact that a plurality of press-fit plug-in contacts 10 can be prepared in a single operation. In the case of the embodiment of the punching 50 illustrated in FIG. 3, a single punching 50 has already been separated from a large punching comprising a plurality of prepared press-fit plug-in contacts 10. Those parts in FIG. 3 that conform with the parts illustrated in the previous Figures are marked by the same reference numerals.

The press-fit contact 10 is produced from the punching 50 illustrated in FIG. 3 by milling. As part of the operations that can be performed on the punching 50 in plane condition, the at least one projection 32*a*, 32*b*; 33*a*, 33*b* provided on the part that later is to become the press-in pin 12, can be worked by removing material from the punching outside the projection 32*a*, 32*b*; 33*a*, 33*b*.

Especially, the supporting edge 23 can be formed particularly easily by milling. The embodiment of the punching 50 illustrated in FIG. 3 shows an expanded section of the cross-section of the contact body 13, which may be provided in certain cases. The expanded section of the cross-section improves the stability of the press-fit contact 10 according to the invention. The expanded section of the cross-section leads to a low ohmic resistance, especially with respect to the preferred embodiment of the press-fit contact 10 according to the invention, for establishing a high-current connection.

It has been assumed in the case of the illustrated embodiment that the forward end of the expanded section of the cross-section, viewed in lengthwise direction 11, is identical to the supporting edge 23 so that both the expanded section of the cross-section and the supporting edge 23 can be produced in a single operation, for example by milling.

Figure 4:
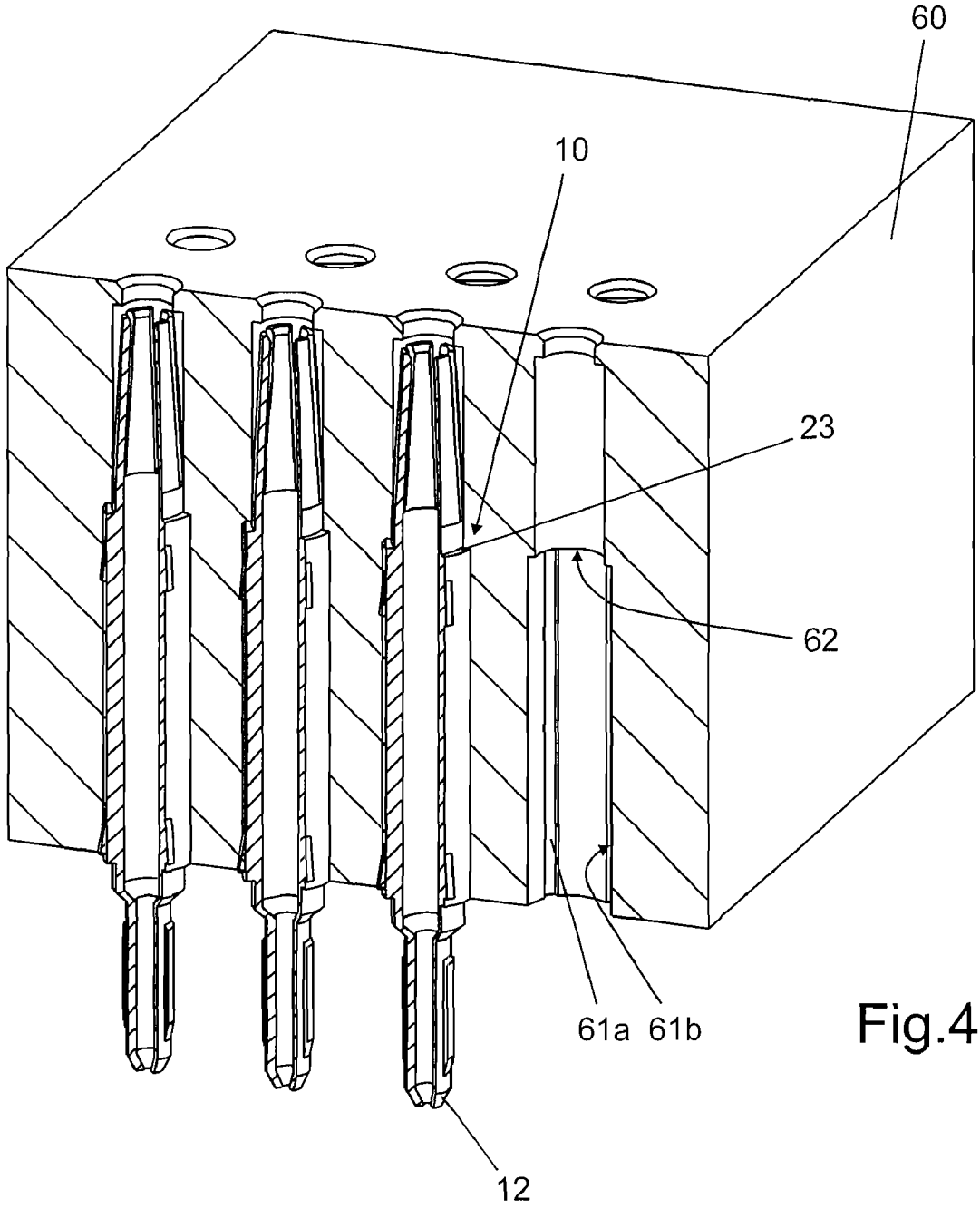
FIG. 4 shows the arrangement of press-fit contacts according to the invention in a plug housing.

FIG. 4 shows the press-fit contact 10 according to the invention after arrangement in a plug housing 60. During introduction of the press-fit plug-in contact 13, the keys 22*a*-22*d* initially engage the forward end of the contact body 13, whereafter the keys 21*a*-21*d* arranged on the rear end of the contact body 13 engage guiding recesses 61*a*, 61*b* corresponding to the keys 21*a*-21*d*; 22*a*-22*d* provided in the plug housing 60.

A press-fit contact 10 is introduced into the plug housing 60 until the supporting edge 23 reaches an abutment 62 for the supporting edge formed in the plug housing 60. Pressing-in of the preferably multiple press-fit contacts 10 arranged in the contact housing 60 may be effected in the illustrated embodiment by exerting a pressure on the plug housing 60 from the top, the supporting edge 23 providing a comparatively large supporting surface, corresponding to the supporting edge, for engagement by an abutment 62 for the supporting edge 23.

The invention claimed is:

1. A press-fit contact for a plug-in connector or a conductor bar comprising:

(a) a forward end;

(b) a rear end; and (c) a press-in pin at said rear end comprising an outer circumferential surface having first and second projections and first and second recesses adjacent to the first and second projections, respectively, in a circumferential direction, and a slot disposed between said first and second projections, said slot having a first boundary face and a second boundary face disposed opposite to said first boundary face;

wherein said first projection is disposed on the first boundary face and said second projection is disposed on the second boundary face so that said first projection faces said second projection in the circumferential direction; and wherein in a pressed-in condition the first and second projections are pressed toward the other so that the first projection resiliently engages the first recess and the second projection resiliently engages the second recess so that the projections and recesses in combination form elastic elements.

2. The press-fit contact as defined in claim 1, wherein at least one wedge is arranged on the outer surface of the press-in pin in the lengthwise direction of the press-in pin.

3. The press-fit contact as defined in claim 1, wherein at least one key is arranged for engagement in a corresponding guide formed in a plug housing.

4. The press-fit contact as defined in claim 1, wherein the press-fit contact is milled from a planar material.

5. The press-fit contact as defined in claim 1, wherein the first recess is implemented as an oblong hole in the lengthwise direction of the press-in pin.

6. The press-fit contact as defined in claim 5, wherein the length of the first projection in the lengthwise direction of the contact pin is maximally equal to length of the first recess configured as an oblong hole.

7. The press-fit contact as defined in claim 1, wherein a supporting edge is disposed between the forward end and the press-in pin in the lengthwise direction.

8. The press-fit contact as defined in claim 7, further comprising a contact body having an expanded cross-section that forms the supporting edge.

9. The press-fit contact as defined in claim 1, further comprising a contact body having an expanded cross-section.

10. The press-fit contact as defined in claim 9, wherein the expanded cross-section forms the supporting edge.

* * * * *